US005735563A

United States Patent [19]

Wood

[11] Patent Number: 5,735,563

[45] Date of Patent: Apr. 7, 1998

[54] LIFTING DEVICES

[75] Inventor: Anthony Wood, Sheffield, England

[73] Assignee: River Don Castings Limited, Sheffield, England

[21] Appl. No.: 746,747

[22] Filed: Nov. 15, 1996

Related U.S. Application Data

[63] Continuation of Ser. No. 338,458, Mar. 22, 1995, abandoned.

[30] Foreign Application Priority Data

May 18, 1992 [GB] United Kingdom ..... 9210601

[51] Int. Cl.[6] ..... B66C 1/66

[52] U.S. Cl. ..... 294/89; 294/1.1; 52/125.4

[58] Field of Search ..... 294/1.1, 68.1, 294/68.3, 81.1, 81.3, 82.1, 89; 52/125.3, 125.4, 698

[56] References Cited

U.S. PATENT DOCUMENTS

| | | | |
|---|---|---|---|
| 474,885 | 5/1892 | Viett | 294/89 |
| 822,769 | 6/1906 | Quist | 294/89 |
| 880,962 | 3/1908 | Blanchard et al. | 294/89 |
| 2,070,586 | 2/1937 | Fitch | 294/68.3 |
| 2,886,370 | 5/1959 | Liebert | 294/82.1 |
| 3,404,503 | 10/1968 | Courtois et al. | 294/89 |
| 3,492,033 | 1/1970 | Mueller | 294/82.1 |
| 3,831,993 | 8/1974 | Drayton et al. | 294/81.1 |
| 3,995,903 | 12/1976 | Ernst | 294/81.3 |
| 4,074,519 | 2/1978 | Garrett | 294/1.1 |
| 4,626,012 | 12/1986 | Weldele | 294/81.3 |

FOREIGN PATENT DOCUMENTS

| | | | |
|---|---|---|---|
| 2 552 739 | 4/1985 | France . | |
| 2 635 768 | 3/1990 | France . | |
| 2906-616 | 8/1980 | Germany | 294/89 |
| 3400-351 | 7/1985 | Germany | 294/1.1 |
| 249-240 | 9/1987 | Germany | 294/1.1 |
| 2 166 412 | 5/1986 | United Kingdom . | |
| 2 171 389 | 8/1986 | United Kingdom . | |

*Primary Examiner*—Dean Kramer

*Attorney, Agent, or Firm*—Kinney & Lange, P.A.

[57] ABSTRACT

A lifting device for a steel structure includes a releasable or integrally formed pin to which a shackle or spreader bar assembly can be secured thereby removing the need for conventional bollards or inset sheaves. The lifting device includes stub members, extending from a column member of the device, which secure the device to the steel structure.

1 Claim, 3 Drawing Sheets

LIFTING DEVICES

This is a file wrapper continuation of application Ser. No. 08/338,458, filed Mar. 22, 1995 now abandoned.

BACKGROUND OF THE INVENTION

The present invention relates to lifting devices for heavy structures.

Heavy offshore structures such as steel framed modules or decks conventionally include lifting devices such as bollards or padeyes connected to strong node points to enable the structures to be lifted by, for example, crane barges. During lifting, large diameter cable slings are attached to the bollards or trunnions (often called padears).

Commonly, over the past few years these lifting devices have been produced as large steel castings which either protrude proud of the deck of the structure thereby necessitating their removal once sited, or comprise an inset sheave or bollard to receive the lifting cable. In this latter construction the lifting device is set into the roof or floor of the structure. One problem associated with both of these lifting devices is that they can be very heavy in order to accommodate the large diameter cable slings required to lift them. An additional problem for the inset type (that is to say a structure having an inset below the roof of the structure) is that the portion which carries the bollard has to be kept open and clear of obstructions in order to receive the cable sling. This means that, roof beam members cannot be framed in from all directions, and that the padear has to be sited on an outside face of the structure to be lifted. In many cases this is a significant disadvantage because the ideal places to lift the structure are at positions closer to the structure's center where roof members are framing in at right angles from four directions.

SUMMARY OF THE INVENTION

The present invention sets out to provide lifting devices for cast steel structures which do not require the presence of bollards or inset sheaves so negating the need for large clearance spaces for the installation of cable slings.

According to the present invention in one aspect, there is provided a lifting device for a cast steel structure including means for connection to a shackle plate or spreader bar assembly.

The lifting device may include a pin to which link plates of a shackle assembly can be connected. The pin may be releasably attached to the cast structure. Additionally or alternatively, the shackle assembly may be releasably attached to the pin.

The attachment points of the lifting device to the cast structure are positioned as close as possible to the center of action of the cast structure thereby minimizing the size and weight of the structure and the bending forces imposed during lifting.

The lifting device may comprise a body portion including a pin-hole for receiving a separate pin; alternatively the pin may be cast as an integral part of the casting to form protrusions from each side of the main body. A column member of the lifting device which frames in from the underside of the casting may be of box or circular section. The body of the cast node may diverge (as a cone) or converge from the interface with a column member of the structure. The other members (usually but not exclusively four in number) may be set on to the body of the cone shaping of the node with their center lines at approximately 90° to each other.

In another aspect, there is provided a lifting device comprising a cast steel node of generally conical shape and including, at its apex, means by which the device can be attached to a lifting mechanism.

BRIEF DESCRIPTION OF THE DRAWINGS

The invention will now be described by way of example only with reference to the accompanying diagrammatic drawings, in which.

DETAILED DESCRIPTION OF THE PREFERRED EMBODIMENTS

Figure 1:
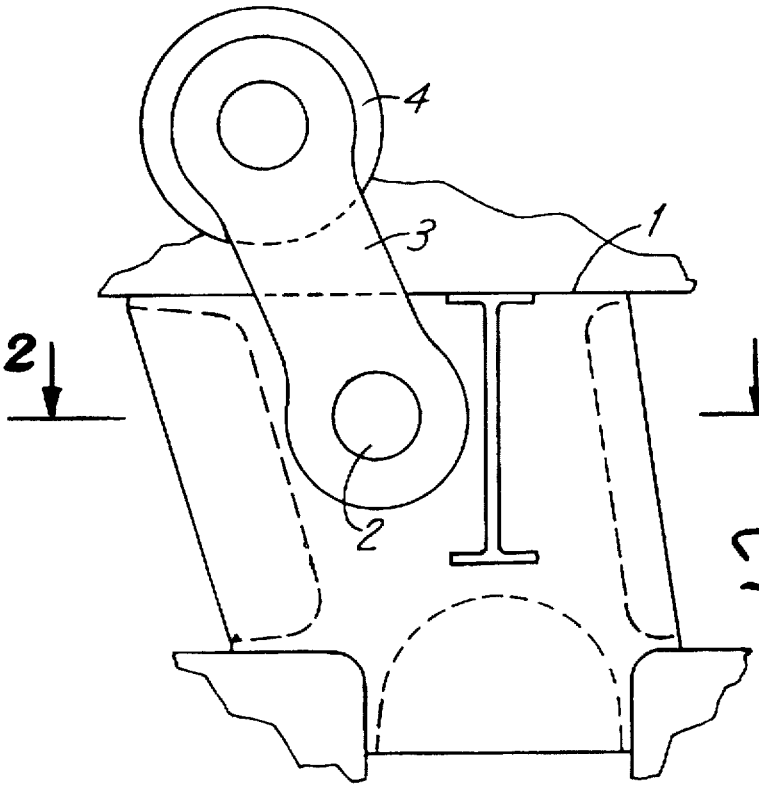
FIG. 1 is a single elevational view of lifting apparatus in accordance with the invention.
Figure 2:
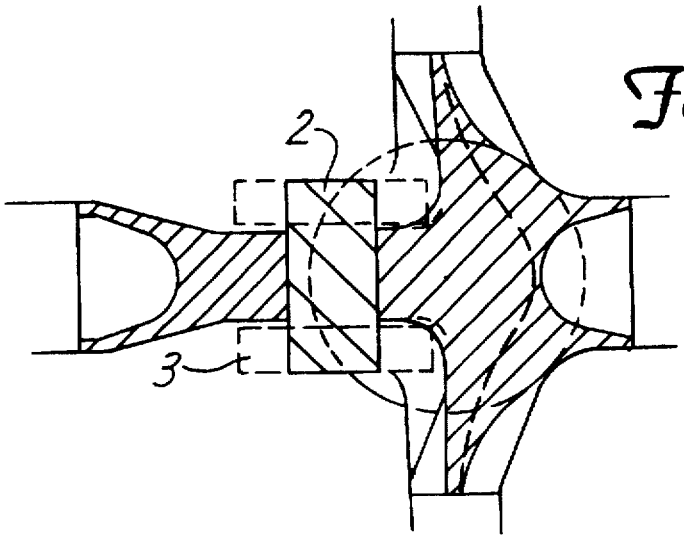
FIG. 2 is a section taken along line II—II of FIG. 1.

The lifting device shown in FIGS. 1 and 2 comprises a cast steel structure 1 including a pin 2 to which are attached link plates 3, of a shackle assembly 4. The link plates 3 may be detachable from the pin 2 to assist uncoupling after lifting and installation. In this embodiment the line of lift action of the lifting device is kept as close as possible to the central work point of the cast structure in order to minimise bending forces in the structure.

Figure 3:
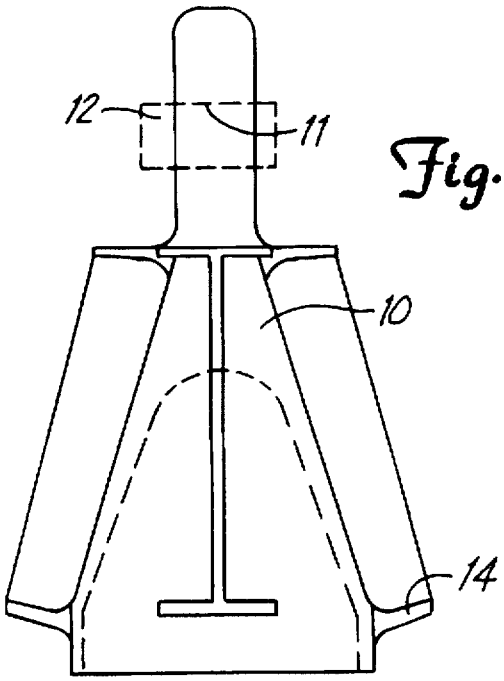
FIGS. 3, 4 and 5 are side elevational, front elevational and plan views of an alternative lifting device in accordance with the invention.
Figure 4:
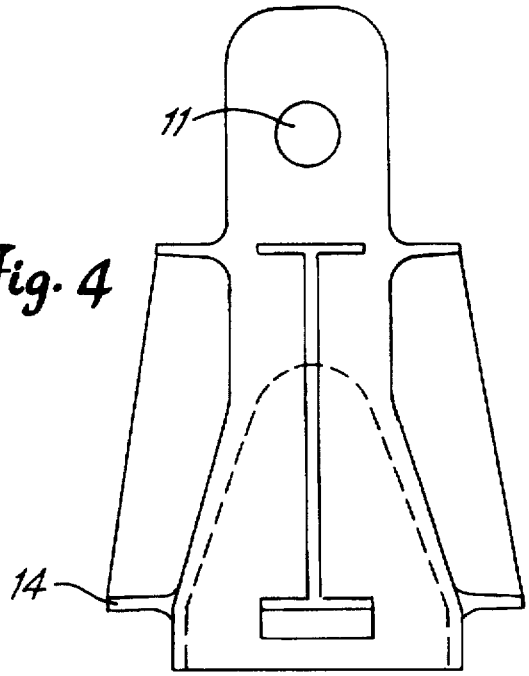
Figure 5:
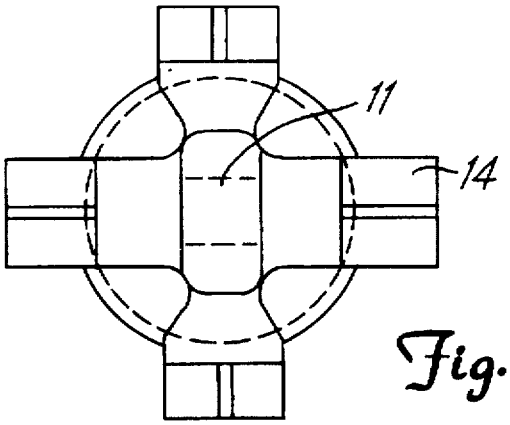

The lifting device illustrated in FIGS. 3 to 5 comprises a cast steel node 10 formed with a bore 11 to receive a pin 12 positioned as close as possible to the work point of the node. For angled cables, it is more likely (though not essential) that a spreader beam will be provided to minimize bending forces.

Figure 6:
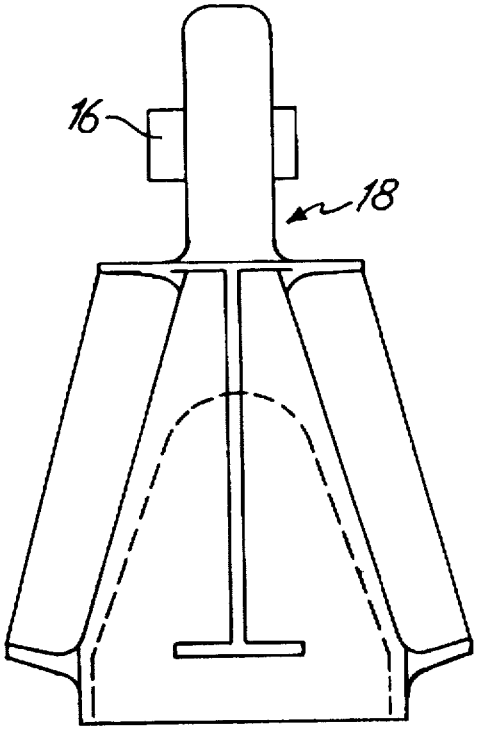
FIG. 6 is a side elevation of an alternative lifting device in accordance with the invention.

The lifting device illustrated in FIG. 6 is identical to that shown in FIGS. 3–5 except that in FIG. 6 pin 16 is integrally formed in cast steel node 18.

The cast steel node 10 generally has a conical or reducing section moving upwards and with stub members 14 extending outwardly in four directions at right angles.

Additionally, when used with high yield strength link plates or spreader bar ends, the lifting devices described above achieve considerable weight savings over conventional types of cast lifting devices.

It will be appreciated that the foregoing is merely exemplary of lifting devices in accordance with the invention and that modifications can readily be made thereto without departing from the true scope of the invention.

What is claimed is:

1. A lifting device for a heavy structure, the device comprising a cast steel node secured to the structure through stub members which extend outwardly from a column member of the node, the cast steel node having a steel pin cast as an integral part of the cast steel node, with the pin ends protruding outside of a portion of the cast steel node for connection to link plates of a shackle assembly to facilitate lifting of the structure.

* * * * *